US008527158B2

(12) United States Patent
Faivre et al.

(10) Patent No.: US 8,527,158 B2
(45) Date of Patent: Sep. 3, 2013

(54) CONTROL SYSTEM FOR A MACHINE

(75) Inventors: Joseph Faivre, Edelstein, IL (US); Lyle Post, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 336 days.

(21) Appl. No.: 12/949,602

(22) Filed: Nov. 18, 2010

(65) Prior Publication Data

US 2012/0130599 A1 May 24, 2012

(51) Int. Cl.
*G05D 1/00* (2006.01)

(52) U.S. Cl.
USPC ..... 701/50; 701/36; 37/411; 37/414; 37/415; 37/416

(58) Field of Classification Search
None
See application file for complete search history.

(56) References Cited

U.S. PATENT DOCUMENTS

| | | | | | |
|---|---|---|---|---|---|
| 4,677,579 | A | * | 6/1987 | Radomilovich | 702/174 |
| 4,776,751 | A | * | 10/1988 | Saele | 414/699 |
| 5,065,326 | A | * | 11/1991 | Sahm | 701/50 |
| 5,160,239 | A | * | 11/1992 | Allen et al. | 414/699 |
| 5,404,661 | A | * | 4/1995 | Sahm et al. | 37/348 |
| 5,408,767 | A | * | 4/1995 | Hazama et al. | 37/396 |
| 5,511,458 | A | | 4/1996 | Kamata et al. | |
| 5,764,511 | A | * | 6/1998 | Henderson | 700/66 |
| 5,768,810 | A | * | 6/1998 | Ahn | 37/348 |
| 5,831,875 | A | * | 11/1998 | Hirata et al. | 703/7 |
| 5,850,341 | A | * | 12/1998 | Fournier et al. | 701/50 |
| 5,854,988 | A | * | 12/1998 | Davidson et al. | 701/50 |
| 5,875,701 | A | | 3/1999 | Cobo et al. | |
| 5,925,085 | A | * | 7/1999 | Kleimenhagen et al. | 701/50 |
| 5,968,103 | A | * | 10/1999 | Rocke | 701/50 |
| 5,987,371 | A | * | 11/1999 | Bailey et al. | 701/50 |
| 6,025,686 | A | * | 2/2000 | Wickert et al. | 318/568.18 |
| 6,032,093 | A | * | 2/2000 | Denbraber et al. | 701/50 |
| 6,047,227 | A | * | 4/2000 | Henderson et al. | 701/50 |
| 6,114,993 | A | * | 9/2000 | Henderson et al. | 342/357.27 |
| 6,140,787 | A | * | 10/2000 | Lokhorst et al. | 318/568.18 |
| 6,211,471 | B1 | * | 4/2001 | Rocke et al. | 177/136 |
| 6,246,939 | B1 | | 6/2001 | Nozawa | |
| 6,257,118 | B1 | | 7/2001 | Wilbur et al. | |
| 6,263,595 | B1 | * | 7/2001 | Ake | 37/348 |
| 6,378,231 | B1 | * | 4/2002 | Moriya et al. | 37/348 |
| 6,466,850 | B1 | * | 10/2002 | Hilgart | 701/50 |
| 6,480,773 | B1 | * | 11/2002 | Hilgart | 701/50 |
| 6,568,898 | B2 | | 5/2003 | Nishimura et al. | |
| 6,711,838 | B2 | * | 3/2004 | Staub et al. | 37/348 |
| 6,766,600 | B2 | * | 7/2004 | Ogura et al. | 37/348 |
| 7,356,397 | B2 | | 4/2008 | Porter | |

(Continued)

FOREIGN PATENT DOCUMENTS

| | | |
|---|---|---|
| JP | 09-071965 | 3/1997 |
| JP | 10-121509 | 5/1998 |
| JP | 11-140910 | 5/1999 |
| JP | 11-217850 | 8/1999 |

*Primary Examiner* — Jonathan M Dager
(74) *Attorney, Agent, or Firm* — Charles S. Cohen; Leydig, Voit & Mayer

(57) ABSTRACT

A control system and method operate to store target signals indicative of end of travel positions of components of a machine. The positions and velocities of the components of a machine are determined at least in part based upon signals received from sensors and command signals are generated to control movement of the components based upon input from an operator, proximate to the end of travel positions and the velocities of the components. Command signals are transmitted to control movement of the components. Multiple end of travel positions may also be defined.

18 Claims, 6 Drawing Sheets

(56) References Cited

U.S. PATENT DOCUMENTS

| | | | | |
|---|---|---|---|---|
| 7,392,125 | B2 | 6/2008 | Ikari | |
| 7,457,698 | B2 * | 11/2008 | Danko | 701/50 |
| 7,478,581 | B2 * | 1/2009 | Price | 91/513 |
| 7,552,539 | B2 * | 6/2009 | Piekutowski | 33/286 |
| 8,065,037 | B2 * | 11/2011 | Danko | 700/250 |
| 8,065,060 | B2 * | 11/2011 | Danko | 701/50 |
| 8,113,763 | B2 * | 2/2012 | Hagenbuch et al. | 414/809 |
| 8,145,355 | B2 * | 3/2012 | Danko | 700/251 |
| 8,205,164 | B2 * | 6/2012 | Kim et al. | 715/764 |
| 8,311,738 | B2 * | 11/2012 | Politick et al. | 701/469 |
| 2002/0104431 | A1 | 8/2002 | Anwar et al. | |
| 2003/0001751 | A1 * | 1/2003 | Ogura et al. | 340/691.6 |
| 2004/0267404 | A1 * | 12/2004 | Danko | 700/245 |
| 2005/0004734 | A1 * | 1/2005 | Cripps | 701/50 |
| 2005/0049838 | A1 * | 3/2005 | Danko | 703/2 |
| 2008/0097672 | A1 * | 4/2008 | Clark et al. | 701/50 |
| 2008/0282583 | A1 * | 11/2008 | Koellner et al. | 37/348 |
| 2009/0018729 | A1 | 1/2009 | Sahlin et al. | |
| 2009/0099738 | A1 * | 4/2009 | Danko | 701/50 |
| 2009/0185888 | A1 | 7/2009 | Lin et al. | |
| 2009/0293322 | A1 * | 12/2009 | Faivre et al. | 37/348 |
| 2010/0283675 | A1 * | 11/2010 | McAree et al. | 342/357.28 |

* cited by examiner

CONTROL SYSTEM FOR A MACHINE

TECHNICAL FIELD

This disclosure relates generally to a control system and, more particularly, to a control system for controlling movement of a work implement near a desired end of travel position of a work tool.

BACKGROUND

Control of machines, such as excavators and material handlers, can be a complex task requiring a significant amount of skill on the part of an operator and typically requires manipulation of multiple input devices such as joysticks. An example may be the movement of a work tool, such as a bucket, along a desired path in a consistent, controlled manner from a first location, such as a dig location, to a second location, such as a dump location. Upon reaching the dump location, the operator will typically operate the input devices to slow down the movement of the work tool in order to accurately position the work tool and, in the case of a bucket, minimize any spillage from the bucket until it is in its desired dump location.

One example of a machine that includes automated control over a portion of movement of a work tool is disclosed in U.S. Pat. No. 5,968,104 (the '104 patent) issued to Egawa, et al. on Oct. 19, 1999. In particular, the '104 patent discloses a hydraulic excavator having an area limiting excavation control system. The area limiting excavation control system has a setting device permitting an operator to set an excavation area at which an end of a bucket is allowed to move. The area limiting excavation control system also includes angle sensors disposed at pivot points of a boom, an arm, and a bucket for detecting respective rotational angles and velocities thereof, a tilt angle sensor for detecting a tilt angle of the excavator's body in a back-and-forth direction (fore/aft direction), and a pressure sensor for detecting a load pressure of the boom as it is moved upward in response to signals generated by a control lever.

The excavation control system limits the speed of the bucket based on changing machine parameters. Specifically, as the bucket nears a boundary of the operator set excavation area during a fore/aft or up/down movement operation (i.e., during a digging operation), the speed of the bucket is slowed in the direction of the boundary such that the bucket stops at the boundary of the excavation area without exiting the desired excavation area. Stopping of the bucket is controlled by adapting flow rate characteristics of control valves associated with movement of the bucket based upon changing machine parameters such as speed, load, position, posture, and temperature. Although the area limiting control system of the '104 patent may improve operator control and machine performance of a hydraulic excavator under some conditions, its system does not provide a full and efficient solution to certain challenges facing the machine operator.

The foregoing background discussion is intended solely to aid the reader. It is not intended to limit the innovations described herein nor to limit or expand the prior art discussed. Thus the foregoing discussion should not be taken to indicate that any particular element of a prior system is unsuitable for use within the innovations described herein, nor is it intended to indicate any element, including solving the motivating problem, to be essential in implementing the innovations described herein. The implementations and application of the innovations described herein are defined by the appended claims.

SUMMARY

In one aspect, a control system for use with a machine is provided. The control system may include a controller configured to store target signals indicative of end of travel positions of a boom, a stick and a frame and receive an operator input device actuation signal indicating a desired movement of the work tool. The controller may also determine positions and velocities of the boom, the stick and the frame based at least in part upon signals received from sensors on the machine and generate command signals to control movement of the boom, the stick and the frame based upon the operator input device actuation signal, proximity of the boom, the stick and the frame to their respective end of travel positions and the velocities of the boom, the stick and the frame. The controller may also transmit the command signals to control movement of the boom, the stick and the frame near the desired end of travel position of the work tool.

Additional and alternative features and aspects of the disclosed control system including a method and a machine will also be appreciated from the following description.

DETAILED DESCRIPTION

Figure 1:
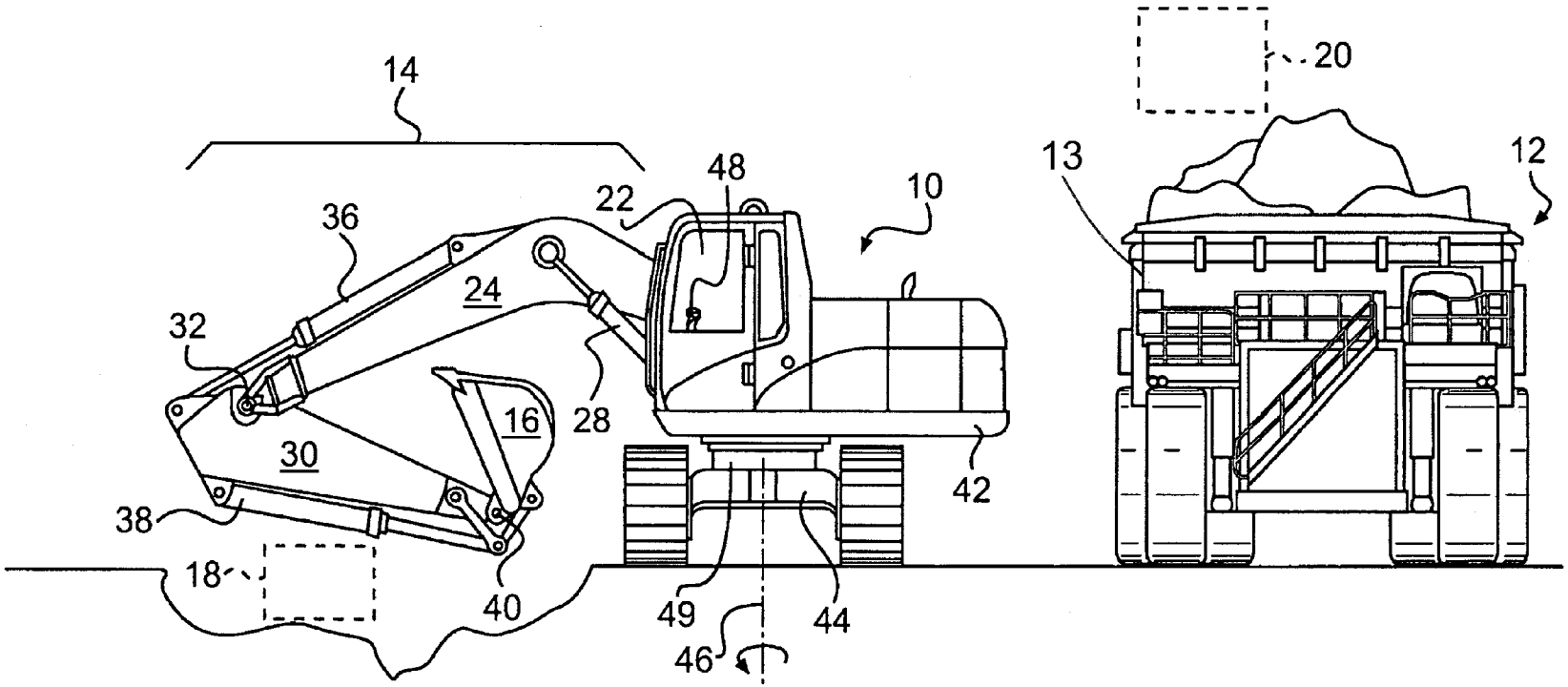
FIG. 1 is a side view of an excavator with an adjacent target vehicle in accordance with the disclosure.

FIG. 1 illustrates an exemplary machine 10 having multiple systems and components that cooperate to excavate and load earthen material onto a nearby target machine such as a haul vehicle 12. In one example, machine 10 may embody a hydraulic excavator. It is contemplated, however, that machine 10 may embody other types of excavation machines such as a backhoe, a front shovel, a wheel loader, or another similar machine as well as a material handler. Machine 10 may include, among other things, an implement system 14 configured to move a work tool 16 between a first position such as a dig location 18 (e.g., within a trench) and a second position such as a dump location 20 (e.g., over a target machine such as a haul vehicle 12), and an operator station 22 for manual control of implement system 14.

Implement system 14 may include a linkage structure utilizing fluid actuators to move work tool 16. More specifically, implement system 14 may include a boom member 24 vertically pivotal relative to frame 42 and propelled by a pair of adjacent, double-acting, boom hydraulic cylinders 28 (only one being shown in FIG. 1). Implement system 14 may also include a stick member 30 vertically pivotal about a horizontal axis 32 between boom members 24 and stick member 30 and propelled by a single, double-acting, stick hydraulic cylinder 36. Implement system 14 may further include a single, double-acting, work tool hydraulic cylinder 38 operatively connected to work tool 16 to pivot work tool 16 vertically about a horizontal axis 40 through stick member 30 and work tool 16. Accordingly, stick member 30 pivotally connects work tool 16 to boom member 24 by way of axes 32 and 40. Frame 42 may be horizontally pivotally connected relative to an undercarriage member 44, and moved about vertical axis 46 by a swing motor 49. It is contemplated that a greater or lesser number of fluid actuators may be included within implement system 14 and connected in a manner other than described above, if desired.

Each of hydraulic cylinders 28, 36, 38 may embody linear actuators having a tube and a piston assembly (not shown) arranged to form two distinct pressure chambers. The pressure chambers may be selectively supplied with pressurized fluid and drained of the pressurized fluid to cause the piston assembly to displace within the tube, thereby changing the effective length of hydraulic cylinders 28, 36, 38. The flow rate of fluid into and out of the pressure chambers may relate to the speed of extension or retraction of hydraulic cylinders 28, 36, 38, while a pressure differential between the two pressure chambers may relate to the force imparted by hydraulic cylinders 28, 36, 38 on the associated linkage members. The extension and retraction of hydraulic cylinders 28, 36, 38 results in the movement of work tool 16.

Similar to hydraulic cylinders 28, 36, 38, swing motor 49 may also be driven by differential fluid pressure. Specifically, swing motor 49 may be a rotary actuator including first and second chambers (not shown) located on opposite sides of an impeller (not shown). Upon filling the first chamber with pressurized fluid and draining the second chamber of fluid, the impeller is urged to rotate in a first direction. Conversely, when the first chamber is drained of fluid and the second chamber is filled with pressurized fluid, the impeller is urged to rotate in an opposite direction. The flow rate of fluid into and out of the first and second chambers impacts the rotational speed of swing motor 49, while a pressure differential across the impeller impacts the output torque thereof.

Numerous different work tools 16 may be attachable to machine 10 and controllable via operator station 22. In addition to the bucket depicted in FIG. 1, work tool 16 may include any device used to perform a particular task such as, for example, a fork arrangement, a blade, a shovel, or any other task-performing device known in the art. Although connected in the embodiment of FIG. 1 to pivot and swing relative to machine 10, work tool 16 may alternatively or additionally rotate, slide or move in any other manner known in the art.

Operator station 22 may include one or more operator input devices 48 embodied as single or multi-axis joysticks (FIG. 2) located proximate to an operator seat (not shown). Operator input devices 48 may be proportional-type controllers configured to position and/or orient work tool 16 by producing a work tool position signal that is indicative of a desired or commanded work tool speed and/or force in a particular direction. It is contemplated that different operator input devices may alternatively or additionally be included within operator station 22 such as, for example, wheels, knobs, push-pull devices, switches, pedals, and other operator input devices known in the art.

Figure 2:
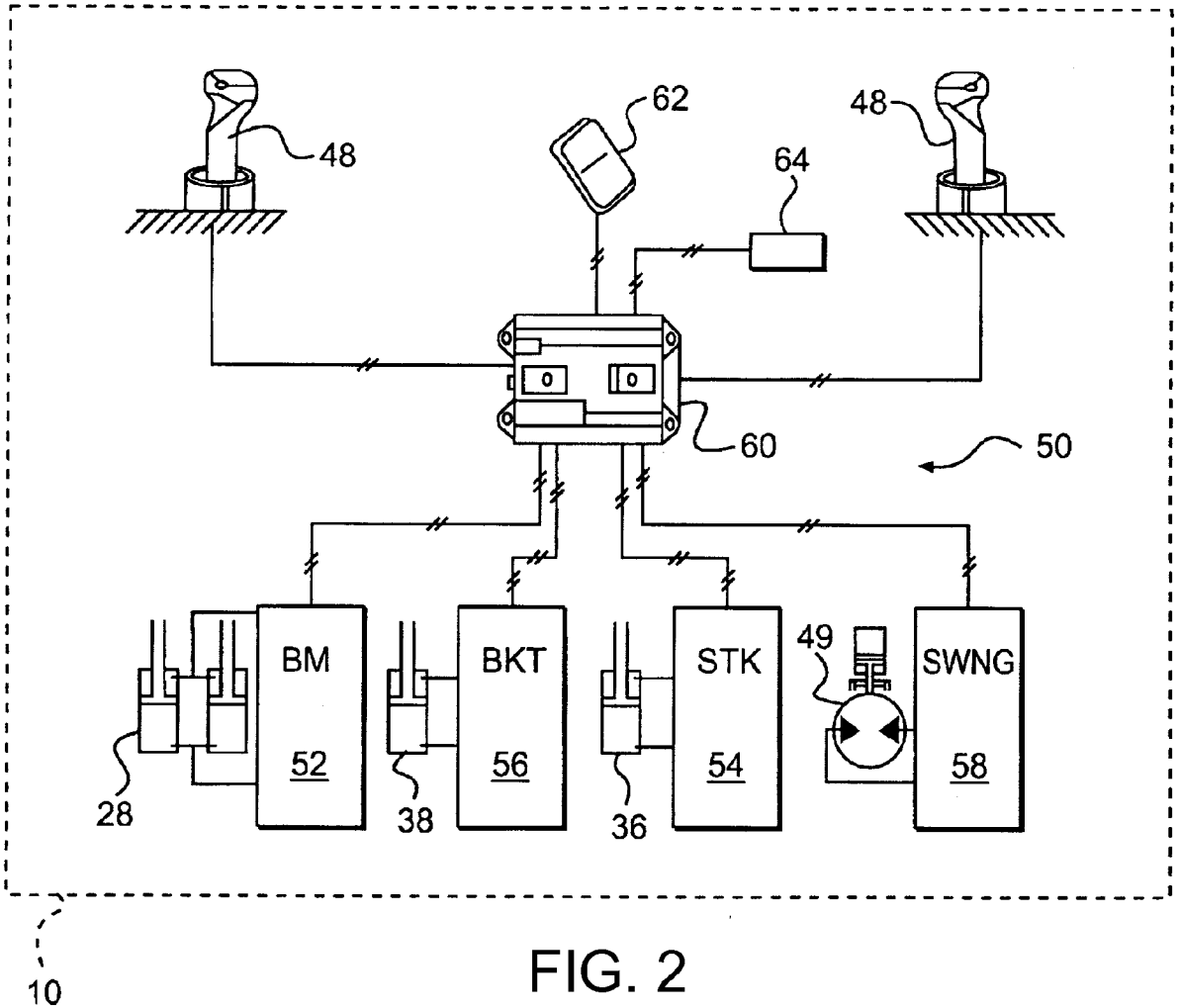
FIG. 2 is a simplified schematic of control components of a control system within the excavator of FIG. 1.

As illustrated in FIG. 2, machine 10 may include a control system 50 including the hydraulic cylinders 28, 36, 38 and swing motor 49 together with other fluid components that cooperate to move work tool 16 in response to input received from operator input device 48. In particular, control system 50 may include one or more fluid circuits (not shown) configured to produce and distribute streams of pressurized fluid. A boom control valve 52, a stick control valve 54, a bucket control valve 56 and a swing control valve 58 may be situated to receive the streams of pressurized fluid and selectively meter the fluid to and from hydraulic cylinders 28, 36, 38 and swing motor 49, respectively, to regulate the motions thereof. Specifically, boom control valve 52 may have elements movable in response to input from the operator to control the motion of boom hydraulic cylinders 28 associated with boom member 24, bucket control valve 56 may have elements movable to control the motion of work tool hydraulic cylinder 38 associated with work tool 16, stick control valve 54 may have elements movable to control the motion of stick hydraulic cylinder 36 associated with stick member 30, and swing control valve 58 may have elements movable to control the swinging motion of frame 42 imparted by swing motor 49.

Since the elements associated with boom, stick, bucket and swing control valves 52, 54, 56, 58 are similar and function in a similar manner, only the operation of boom control valve 52 will be discussed herein. In one example, boom control valve 52 may include a first chamber supply element (not shown), a first chamber drain element (not shown), a second chamber supply element (not shown), and a second chamber drain element (not shown). To extend boom hydraulic cylinders 28, the first chamber supply element is moved to allow the pressurized fluid to fill the first chambers of boom hydraulic cylinders 28 with pressurized fluid while the second chamber drain element is moved to drain fluid from the second chambers of boom hydraulic cylinders 28. To move boom hydraulic cylinders 28 in the opposite direction, the second chamber supply element is moved to fill the second chambers of boom hydraulic cylinders 28 with pressurized fluid while the first chamber drain element is moved to drain fluid from the first chambers of boom hydraulic cylinders 28. It is contemplated that both the supply and drain functions may alternatively be performed by a single element associated with the first chamber and a single element associated with the second chamber, or by a single valve that controls all filling and draining functions, if desired.

The supply and drain elements may be movable by solenoids (not shown) in response to a command. More specifically, hydraulic cylinders 28, 36, 38 may extend and swing motor 49 may rotate at a speed that substantially corresponds to the flow rate of fluid into and out of the first and second chambers, and with a force that substantially corresponds to the pressure of the fluid. To achieve an operator-desired or commanded speed and/or force indicated via the operator input device, a command based on an assumed or measured pressure may be sent to the solenoids (not shown) of the supply and drain elements that causes them to open an amount corresponding to the necessary flow rate. As such, a larger opening of the supply and drain elements will generally result in faster movement of cylinders 28, 36, 38 and swing motor 49 while a smaller opening will generally result in slower movement. When the supply and drain elements are completely closed, movement will be generally inhibited. The command may be in the form of a flow rate command or a valve element position command.

Control system 50 may also include a controller 60 in communication with operator input device 48 and boom, stick, bucket and swing control valves 52, 54, 56, 58 to coordinate the movements described above. Controller 60 may embody a single microprocessor or multiple microprocessors that include a means for controlling the operation of control system 50. Numerous commercially available microprocessors can be configured to perform the functions of controller 60. It should be appreciated that controller 60 could readily be embodied in a general machine microprocessor capable of controlling numerous machine functions. Controller 60 may include memory, secondary storage devices, processors, and any other components for running an application. Various other circuits may be associated with controller 60 such as power supply circuitry, signal conditioning circuitry, solenoid driver circuitry, and other types of circuitry.

One or more maps relating the input device position signal, desired actuator speed or force, associated flow rates and pressures, and/or valve element positions associated with movement of hydraulic cylinders 28, 36, 38 and swing motor 49 may be stored in the memory of controller 60. Each of these maps may include a collection of data in the form of tables, graphs, and/or equations. In one example, desired speed and commanded flow rate may form the coordinate axis of a 2-D table for controlling the first and second chamber supply and drain elements described above. The commanded flow rate required to move the fluid actuators at the desired speed and the corresponding valve element position of the appropriate supply and drain elements may be related in another separate 2-D map or together with desired speed in a single 3-D map. It is also contemplated that desired actuator speed may be directly related to the valve element position in a single 2-D map. Controller 60 may be configured to allow the operator of machine 10 to directly modify these maps and/or to select specific maps from available relationship maps stored in the memory of controller 60 to affect fluid actuator motion. It is contemplated that the maps may additionally or alternatively be automatically selectable based on modes of machine operation, if desired.

Controller 60 may be configured to receive input from operator input device 48 and to command operation of control valves 52, 54, 56, 58 in response to the input and based on the relationship maps described above. Specifically, controller 60 may receive the input device position signal indicative of a desired speed and/or force of work tool 16 in a particular direction, and reference the selected and/or modified relationship maps stored in the memory of controller 60 to determine flow rate values and/or associated positions for each of the supply and drain elements within control valves 52, 54, 56, 58. The flow rates or positions may then be commanded of the appropriate supply and drain elements to cause filling and/or draining of the first or second chambers at rates that result in the desired work tool movement.

Control system 50 may be equipped with one or more sensors 64 for monitoring the position and velocity of the various components of machine 10. In one example, the sensors 64 may be position sensors associated with each of hydraulic cylinders 28, 38, 36 to determine the amount of displacement of each of the boom hydraulic cylinders 28, the stick hydraulic cylinder 36 and the work tool hydraulic cylinder 38, respectively. In another example, the sensors 64 may be angle sensors associated with the pivot joints of implement system 14. In another example, the sensors 64 could be inclinometers and/or gyroscopes. The sensors 64 may also include tilt sensors configured to detect a pitch and a roll of frame 42 and may include sensors for determining the position and orientation of the machine relative to a local or global references such as by using, for example, a local laser system or one or more global position system ("GPS") sensors. In some instances, a pair of GPS sensors may be used. In other instances, a single GPS sensor may be used to determine global position together with a compass to determine orientation. In addition, the sensors 64 may include elements capable of determining velocity or angular velocity as well as load sensors configured to detect a payload of work tool 16 (i.e., a mass of material contained within and transported by work tool 16). The combination of sensors 64 may be chosen as desired for the particular needs and applications of machine 10. Based on signals generated from sensors 64 and based on known kinematics of machine 10, controller 60 is configured to command control valves 52, 54, 56, 58 to position work tool 16 relative to the dig and dump locations at the speeds and/or forces desired by the operator. In addition, based on the signals generated by sensors 64, controller 60 may be able to derive and record some or all of the positions, velocities, accelerations, orientations, masses, and/or inertias of implement system 14.

In some situations, controller 60 may be configured to selectively limit movement of implement system 14. More specifically, when performing repetitive tasks such as digging and loading a haul vehicle 12, an operator may desire to use controller 60 to control or limit movement of the work tool as it approaches one or more locations. For example, if work tool 16 is a bucket and the operator is performing a sequence of digging operations at dig location 18 and then moving the bucket to a dump location 20 over haul vehicle 12, the operator may want to utilize automated or semi-automated controls to assist in positioning work tool 16 in conjunction with the dumping operation. Referring to flowchart 100 in FIG. 3, the operator initially defines and stores a target or end of travel position for dumping the bucket. The definition and storage can be accomplished in numerous manners but in each instance, as indicated at stage 102, desired target signals for sensors 64 indicative of the end of travel position of each of boom member 24, stick member 30 and frame 42 may be identified. In addition, sensors 64 indicating pitch and roll of frame 42 may also be used to identify desired pitch and roll target signals. At stage 104, the generated target signals are stored within controller 60.

As an operator manipulates one or more operator input devices 48 to perform any of a variety of tasks with implement system 14, signals generated by the operator input devices 48 are transmitted to and received by controller 60 at stage 106. Data signals from the various sensors 64 of machine 10 are received by controller 60 at stage 108. If desired, the data signals may be conditions such as by filtering, amplification and format or protocol conversion at stage 110. Controller 60 utilizes the data from sensors 64 to determine the positions and velocities of work tool 16, boom member 24, stick member 30 and frame 42 at stage 112. Pitch and roll data may also be utilized by controller 60 to further define the positions of work tool 16, boom member 24, stick member 30 and frame 42. At stage 114, based upon data received from sensors 64, controller 60 determines whether work tool 16 is moving towards or away from the end of travel position. If the work tool is moving away from the end of travel position (and thus stage 114 is not satisfied), controller 60 will not modify the operator input signals from the operator input devices 48 (stage 120) and control system 50 will be controlled by the operator input signals at stage 122. However, if the work tool is moving towards the end of travel location (i.e., the dump location), the signals from the operator input devices are compared to values in the data map based upon the positions and velocities of work tool 16, boom member 24, stick member 30 and frame 42 and potentially the pitch and roll of frame 42 at stage 116.

The data map may be generally configured to assist in slowing movement of each of boom member 24, stick member 30 and frame 42 and thus work tool 16 as the work tool approaches the end of travel position to simplify the operator's efforts in positioning the work tool at the end of travel position. Accordingly, if, and to the extent that, the operator input signals from the operator input devices 48 are less than the values in the data map, controller 60 will not modify the operator input signals from the operator input devices 48 at stage 120 and the operator input signals will be used as command signals by controller 60 to control the control system 50 at 122. However, for those aspects of the operator input signals that meet the conditions of stage 116 (i.e., any operator input signals that are greater than the data map values), command signals for controlling control system 50 are generated using data from the data map at stage 118 and subsequently transmitted to the control system at stage 122. With such a control system, as the work tool 16, such as a bucket, approaches the end of travel position such as dump location 20, movement of work tool 16 generated by movement of each of hydraulic cylinders 28 and 36 and swinging movement generated by swing motor 49 is slowed down or damped to the lesser of the speed directed by the operator through operator input devices 48 or that specified by the data map of controller 60. In other words, if the operator is moving boom member 24 and/or stick member 30 vertically and/or swinging frame 42 more slowly than the speed that would result from a command based on the data map, the operator's input signals will control the operation of each component that is moving more slowly than the data map value while those components for which the operator input device commands movement that is faster than the data map value will be moved at the data map value. It should be noted that since controller 60 may assume control based on speed, the location at which controller 60 assumes control may vary. For example, the faster the movement of boom member 24, the more likely it is to be controlled at a greater distance from the end of a travel position in order to reduce the likelihood of an abrupt change in speed or deceleration of boom member 24.

Figure 3:
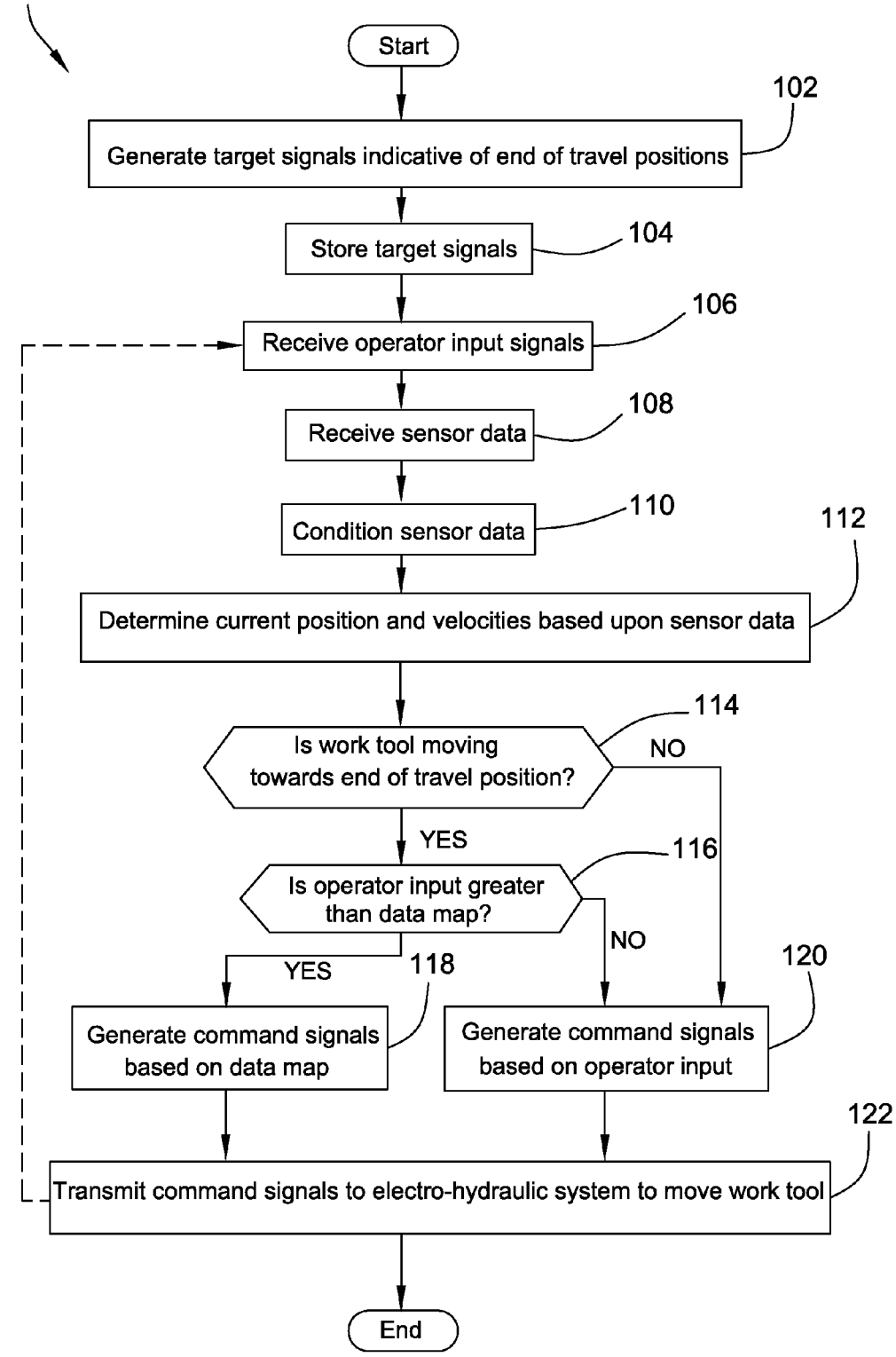
FIG. 3 is a flowchart illustrating a process for controlling components of the excavator near an end of travel position.
Figure 4:
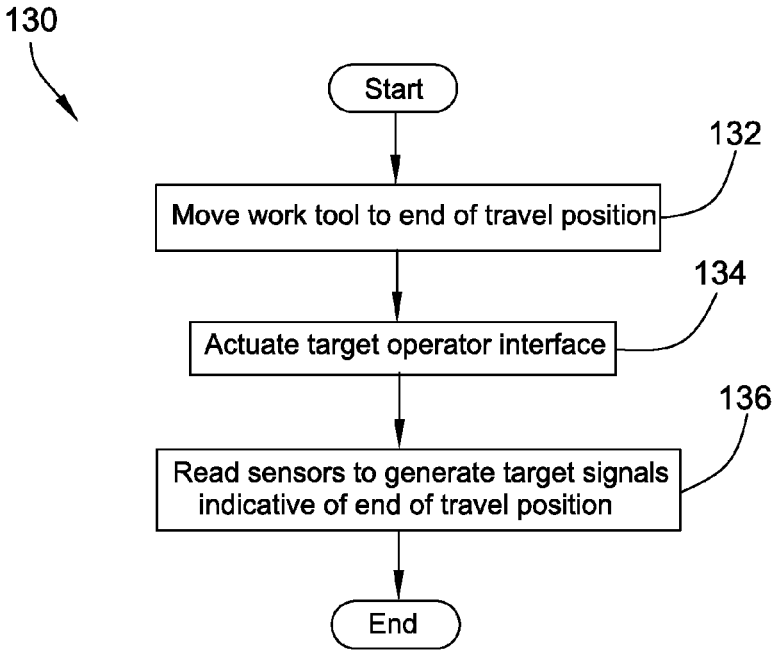
FIG. 4 is a flowchart illustrating a process for generating target signals indicative of an end of travel position.

As stated above, the generation of target signals indicative of the end of travel position at stage 102 may be performed in a variety of manners. Flowchart 130 in FIG. 4 depicts one example in which, at stage 132, the operator utilizes operator input devices 48 to position work tool 16 in a desired end of travel position such as dump location 20. Upon actuating a target operator interface such as switch 62 (FIG. 2) at stage 134, data from each sensor is read at stage 136 to determine target data values with the work tool 16 at the desired end of travel position. More specifically, the data signals from each of the sensors 64 associated with boom member 24, stick member 30 and frame 42 are read and utilized as target signals to indicate the desired end of travel positions for each of boom member 24, stick member 30 and frame 42 at stage 102 of FIG. 3. If machine 10 also includes other sensors 64, such as those for indicating pitch and roll, as well as those for indicating local or global position and orientation, the data signals from those sensors may also be read and utilized as additional target signals indicative of the desired end of travel positions.

Figure 5:
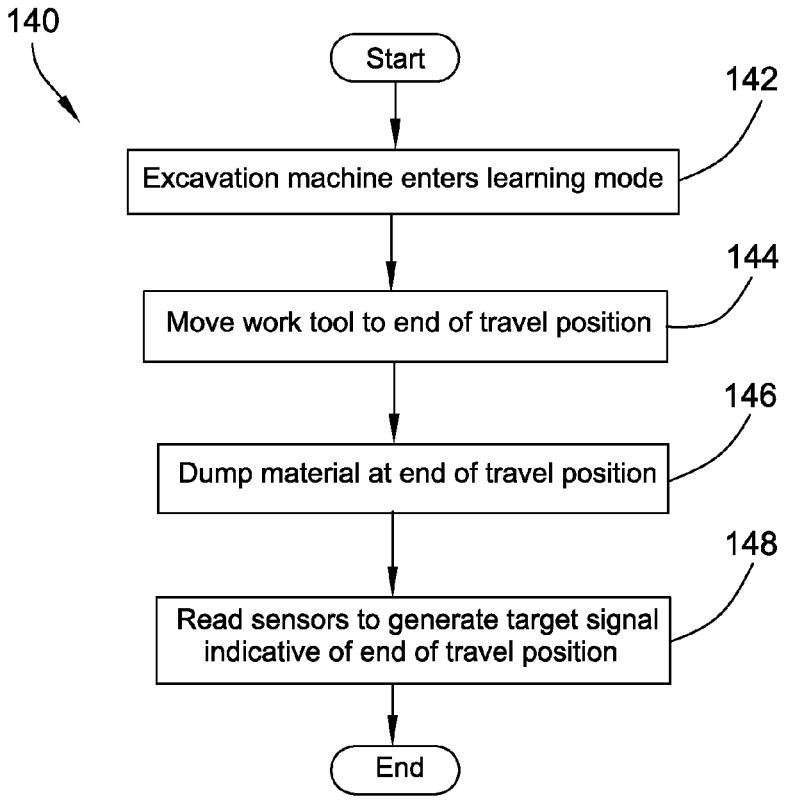
FIG. 5 is a flowchart illustrating an alternate process for generating target signals indicative of an end of travel position.

In another example of generating target signals at end of travel positions, flowchart 140 in FIG. 5 depicts the generation of target signals beginning with machine 10 entering into a learning mode such as by actuating an operator interface (e.g., switch 62) at stage 142. Other manners of entering a learning mode may be used including configuring controller 60 to enter a learning mode upon turning the machine on. Once in a learning mode, the operator utilizes operator input devices 48 to position work tool 16 in a desired end of travel position at stage 144 such as dump location 20 for dumping the bucket. Upon moving work tool 16 to perform a predetermined operation stage 146, such as by dumping the bucket, each sensor is read at stage 148 to determine data values with the work tool 16 at the desired end of travel position. More specifically, the data signals from each of the sensors 64 associated with boom member 24, stick member 30 and frame 42 are read and utilized as target signals to indicate the desired end of travel positions for each of boom member 24, stick member 30 and frame 42 at stage 102 of FIG. 3. If machine 10 also includes other sensors 64, such as those for indicating pitch and roll, as well as those for indicating local or global position and orientation, the signals from those sensors may also be read and utilized as additional target signals indicative of the desired end of travel position.

Figure 6:
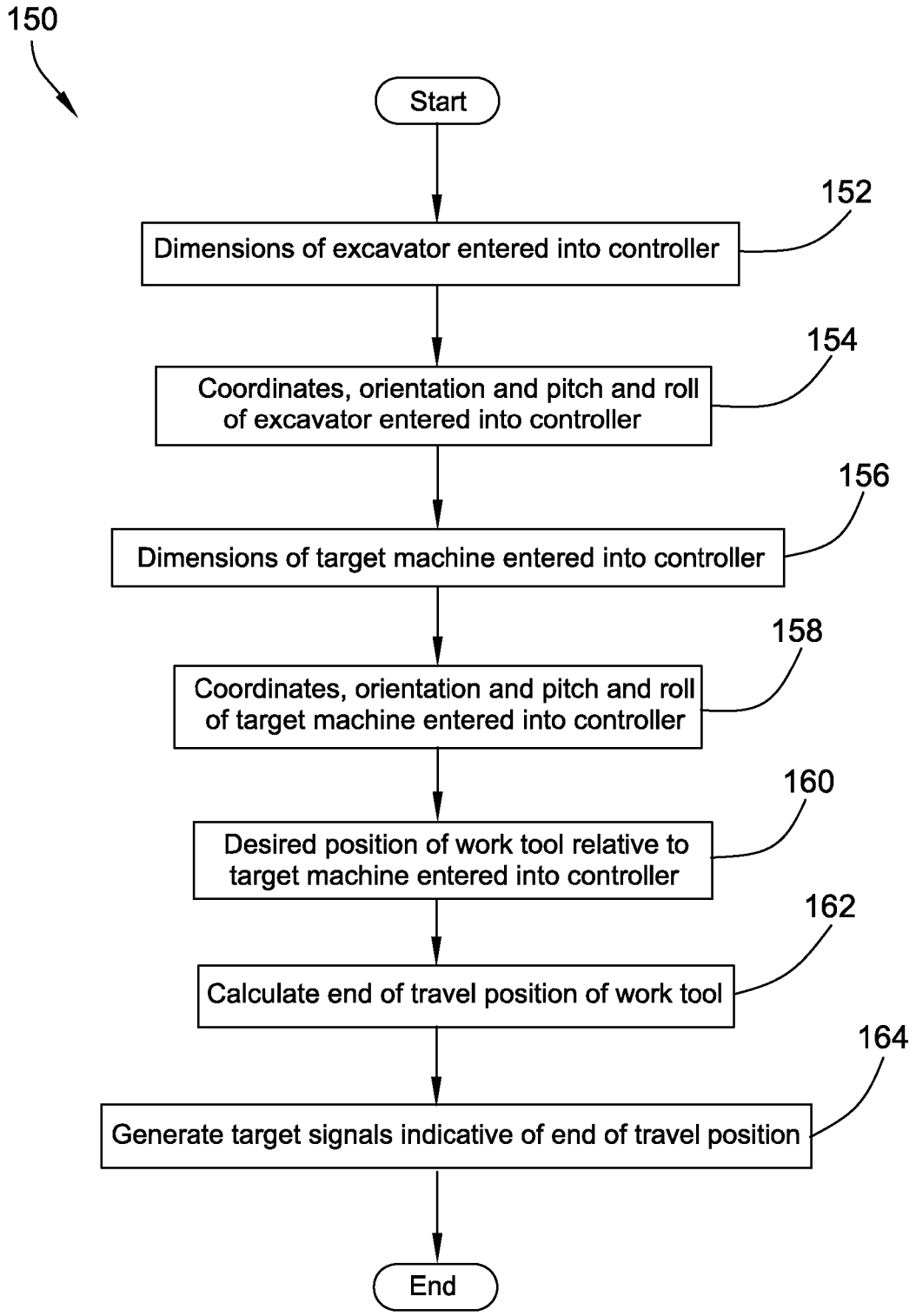
FIG. 6 is a flowchart illustrating still another process for generating target signals indicative of an end of travel position.

In still another example, target signals may be generated or calculated by controller 60 as depicted in flowchart 150 in FIG. 6. At stage 152, dimensions of machine 10 are entered into controller 60. These dimensions include detailed dimensions of work tool 16 together with each component that affects the movement of work tool 16 such as boom member 24, stick member 30, frame 42 and undercarriage member 44. The dimensions of each component together with data from the sensors 64 associated with work tool 16, boom member 24, stick member 30 and frame 42 permit controller 60 to calculate the specific position of the boundary of work tool 16 (as well as the boundaries of the other components of machine 10) and to control the movement of machine 10 based on the calculated positions. At stage 154, the global position and orientation of machine 10 as well as the pitch and roll of frame 42 are entered into controller 60. The entry of such data may be manual, automated or a semi-automatic combination. A pair of spaced apart GPS sensors 64 may be mounted on machine 10 and used to determine the machine's global position, orientation and pitch and roll. In an alternate structure, a single GPS sensor 64 may be utilized to determine the global position of machine 10 together with a compass to indicate the orientation of machine 10 and other sensors to determine pitch and roll.

At stage 156, dimensions of a target machine, such as haul vehicle 12, are entered into controller 60. The dimensions of the target machine may include, in the haul vehicle example, the length and width of the body or dump box 13 (FIG. 1) together with the height of the top of the dump box above a reference ground surface. At stage 158, the global position and orientation of the target machine together with its pitch and roll are entered into controller 60. A pair of spaced apart GPS sensors 64 may be mounted on the target machine and used to determine the target machine's global position, orientation and pitch and roll. In one alternative structure, a single GPS sensor 64 may be utilized to determine the global position of the target machine together with a compass to indicate the orientation of the target machine and additional sensors utilized to determine the pitch and roll of the target machine. As a result, the exact location of the perimeter of the top of dump box 13 is known.

At stage 160, a desired end of travel position such as a dump location relative to the top of dump box 13 may be set. An operator may set a specific location such as one relative to the length and width of the dump box together with the height relative to the top of the dump box or may utilize a default setting that may set the dump location as a predefined location relative to the dimensions of the dump box such as, for example, at its center and a predetermined height above the top of the dump box. Based upon the input dimensions, location, orientation and pitch and roll of the target vehicle, a desired end of travel position of work tool 16 such as a bucket is calculated at stage 162. At stage 164, controller 60 utilizes the calculated end of travel position of work tool 16 together with the input dimensions, location, orientation and pitch and roll of machine 10 to generate target signals indicative of end of travel positions of boom member 24, stick member 30 and frame 42.

If desired, controller 60 may be configured to limit movement of work tool 16 at a series of two or more spaced apart positions in a predetermined sequence. For example, depending on the size of the bucket at the end of the implement system 14, the size of haul vehicle 12 and the material being moved, it may be desirable to dump the material at alternating positions in the haul vehicle. Such a process is set forth in flowchart 170 in FIG. 7 and operates in a manner similar to that set forth in flowchart 100 in FIG. 3 but with a target or end of travel position changing after each dumping operation. As with the process of FIG. 3, first target signals are generated at stage 172 corresponding to the first end of travel position. The first target signals may be generated in a manner as set forth in FIG. 4 in which the work tool is moved to the desired first end of travel position at stage 132. A target operator interface such as switch 62 is actuated at stage 134 and the sensors 64 are read at stage 136 with the data from the sensors being used as first target signals indicative of the first end of travel position. These first target signals are then stored within controller 60 at stage 174 of FIG. 7. The process is then repeated to generate second target signals at stage 176 by defining a second end of travel position such that the work tool is moved to the desired second end of travel position in a manner similar to that indicated at stage 132. A target operator interface such as switch 62 is actuated at stage 134 and the sensors 64 are read at stage 136 with the data from the sensors being used as second target signals indicative of the second end of travel position. These second target signals are then stored within controller 60 at stage 178.

Controller 60 sets the target position to correspond to the first end of travel position at stage 180. Once the end of travel position has been set, the operator may operate machine 10 as desired until the work tool reaches the first end of travel position at stage 182. While moving to the first end of travel position, the process of stages 106-122 of FIG. 3 is followed with the first target signals corresponding to the first end of travel positions being used as the target signals of FIG. 3. Once a predetermined operation, such as dumping the bucket at the first end of travel position has occurred (stage 184), controller 60 changes the target signals identified in FIG. 3 to correspond to the second target signals corresponding to the second end of travel positions at stage 186. If, for any reason, the operator moves the bucket to the first end of travel position but does not perform the predetermined operation such as dumping the bucket (stage 184), controller 60 will continue to limit movement of work tool 16 near the first end of travel position until the predetermined operation has occurred. After the target signals are changed to the second target signals, at stage 186, the process of stages 116-132 of FIG. 3 is followed with the second target signals corresponding to the second end of travel positions being used as the target signals of FIG. 3. The operator may operate machine 10 as desired until work tool 16 reaches the second end of travel position at stage 188. Once the predetermined operation, such as dumping the bucket at the second end of travel position, has occurred (stage 190), controller 60 changes the target signals identified in FIG. 3 to correspond back to the first target signals corresponding to the first end of travel positions at stage 180. This sequence of alternating between first and second end of travel positions may be repeated until a signal is sent to the controller to terminate the alternating sequence of operation.

Figure 7:
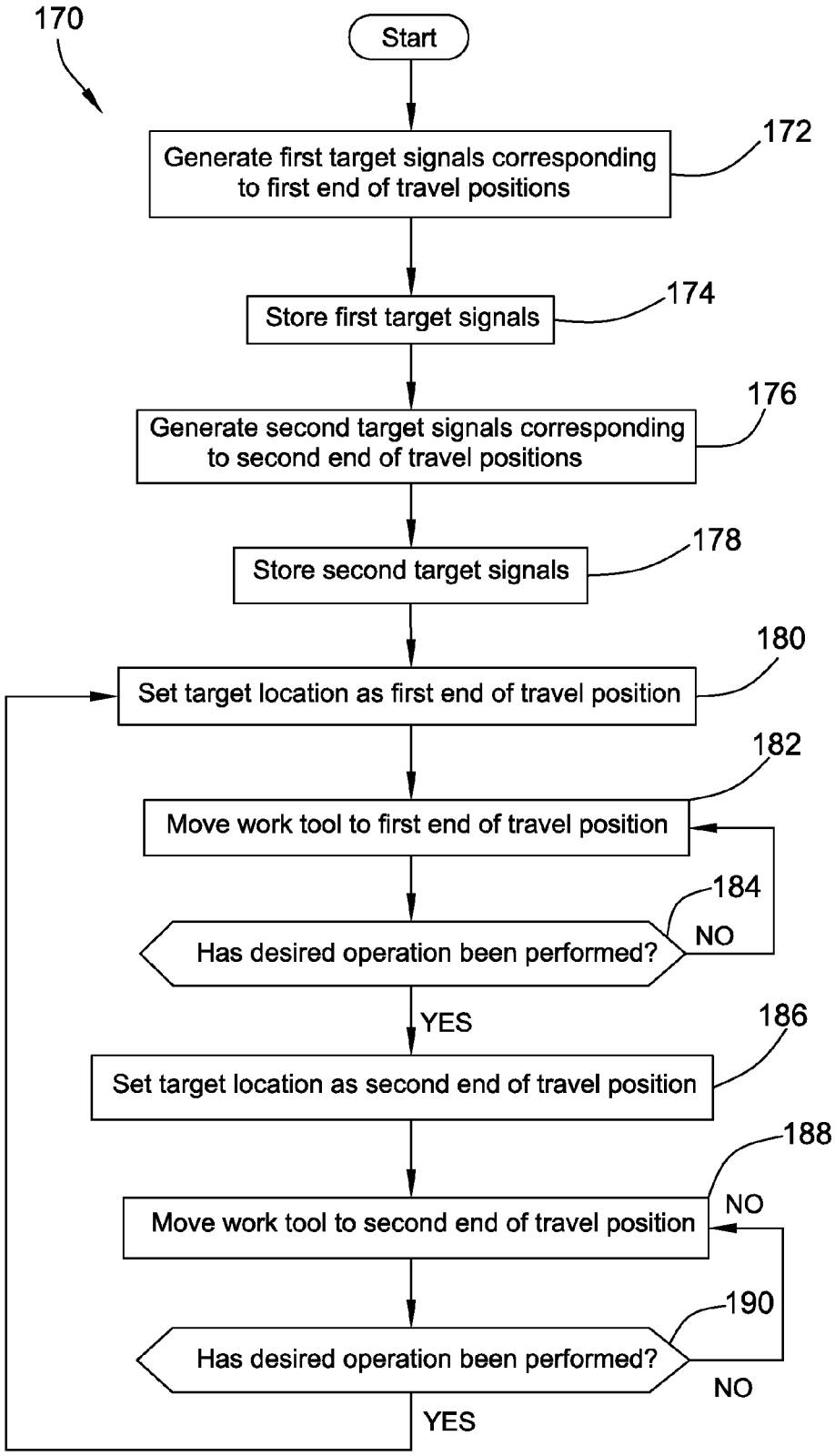
FIG. 7 is a flowchart illustrating a process for sequentially controlling components of the excavator between two end of travel positions.

Other manners of defining or establishing multiple end of travel positions may be used such as using the process set forth in FIG. 5 and instructing controller 60 to read the data from the sensors at stage 148 the first time work tool 16 performs a predetermined operation, such as dumping the bucket, and storing the data as the target signals corresponding to the first end of travel positions at stage 174 of FIG. 7. An operator may continue operation of machine 10 and the controller may read the sensor data at stage 158 a second time once work tool 16 performs the predetermined operation, such as dumping the bucket, at a second location and storing the data as the target signals corresponding to the second end of travel positions at stage 178 of FIG. 7. In another alternate manner of defining multiple end of travel positions, an operator may select a mode in which the controller 60 includes a set pattern of end of travel positions, such as based upon the type and size of the target vehicle. In still another alternate manner of defining multiple end of travel positions, the process set forth in FIG. 6 may be used to generate the target end of travel signals by calculating their values based on the dimensions of machine 10 and haul vehicle 12 as well as the global position, orientation and pitch and roll of each. During stage 160 of FIG. 6 at which the operator may set a specific location relative to the length and width of the dump box 13 and height relative to the top of the dump box, the operator may specify desired locations as the first and second end of travel positions or instruct the controller to calculate the first and second end of travel positions based upon the dimension of the dump box. Although the process set forth in FIG. 7 is depicted with two end of travel positions, more than two end of travel positions may be utilized by defining additional end of travel positions and a desired sequence of alternating between end of travel positions.

It should be noted that in each example of generating or calculating target signals corresponding to the end of travel position, such signals may include the pitch and roll of frame 42. If, after storing the target signals, the current pitch or roll of frame 42 were to change, controller 60 may function to recalculate the target signals for each of the boom member 24, the stick member 30, and the frame 42 based upon the kinematics of the machine 10 and store such recalculated signals as the target signals. Similarly, if the pitch and roll of the target vehicle were monitored and utilized as part of the generation or calculation of the target signals of the boom member 24, the stick member 30, and the frame 42 as well the target pitch and roll of frame 42, and the current pitch and roll of the target vehicle were to change, controller 60 may function to recalculate the target signals for each of the boom member 24, the stick member 30, and the frame 42 based upon the kinematics of the machine 10 and store such recalculated signals as the target signals.

INDUSTRIAL APPLICABILITY

The industrial applicability of the control system described herein will be readily appreciated from the foregoing discussion. The present disclosure is applicable to many machines and many tasks accomplished by machines. One exemplary machine for which the control system is suited is an excavator. However, the control system may be applicable to any excavation machine or material handler that benefits from control of a work tool near an end of travel position.

The disclosed control system may modify command signals from an operator of a machine when a work tool reaches a position a predetermined distance from the end of travel position in order to slow or control movement of the work tool. If the work tool is a spaced from the end of travel position a distance greater than the predetermined distance, the work tool is moving away from the end of travel position or the movement is slower than a modified command that would be generated by the controller, the machine is controlled by commands from the operator rather than by a controller of the control system. In an example, the control system is configured to slow down or damp movement of aspects of an implement system in order to slow the movement of the work tool near an end of travel position. It is generally desirable to avoid abrupt changes in movement of a work tool in order to reduce any spillage of material from the work tool. The control system simplifies the operation of a machine by assisting the operator to avoid rapid deceleration and assist in precisely positioning a bucket near an end of travel position prior to a dumping operation.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A control system for controlling movement of a work tool of a machine near a desired end of travel position of the work tool, the machine including a boom member operatively connected to a frame, a stick member operatively connected to the boom member and the work tool operatively connected to the stick member, the control system comprising:

a controller configured to:

store target signals indicative of end of travel positions of the boom member, the stick member and the frame;

receive signals indicative of actuation of an operator input device associated with the machine, the operator input device actuation signals indicating a desired movement of the work tool;

determine positions and velocities of the boom member, the stick member and the frame based at least in part upon signals received from sensors on the machine;

compare desired speeds of movement of the boom member, the stick member and the frame based upon the operator input device actuation signals to a data map including speeds of movement of the boom member, the stick member and the frame based upon proximity to their respective end of travel positions and the velocities of the boom member, the stick member and the frame;

generate command signals to control movement of the boom member, the stick member and the frame based upon whichever movements are slower as between the desired speeds of movement and the data map speeds of movement upon the work tool moving towards the end of travel position;

generate command signals to control movement of the boom member, the stick member and the frame at the desired speeds of movement upon the work tool moving away from the end of travel position; and transmit the command signals to the control system to control movement of the boom member, the stick member and the frame near the desired end of travel position of the work tool.

2. The control system of claim 1, wherein the controller is further configured to store signals indicative of positions of the boom member, the stick member and the frame as the target signals based upon positioning of the work tool at the desired end of travel position and actuation of a target operator input device associated with the machine.

3. The control system of claim 1, wherein the controller is further configured to store automatically the target signals upon entering a learning mode and the work tool performing a predetermined operation.

4. The control system of claim 1, wherein the controller is further configured to generate signals indicative of desired end positions of the boom member, the stick member and the frame at least in part based upon predetermined dimensions and a global positioning signal of the machine together with predetermined dimensions and a global positioning signal of a target machine positioned near the desired end of travel position of the work tool and store the generated signals as the target signals.

5. The control system of claim 4, wherein the target machine includes a load receiving structure and the predetermined dimensions include a height of the load receiving structure relative to a ground reference together with dimensions thereof.

6. The control system of claim 1, wherein the controller is further configured to store the target signals based upon at least two of three modes of operation, including:

a first mode including actuation of a target operator input device to store signals indicative of positions of the boom member, the stick member and the frame as the target signals;

a second mode in which moving the work tool to a dumping orientation automatically stores signals indicative of positions of the boom member, the stick member and the frame as the target signals; and a third mode including generation of signals indicative of desired end positions of the boom member, the stick member and the frame at least in part based upon predetermined dimensions and a global positioning signal of the machine together with predetermined dimensions and a global positioning signal of a target machine near the desired end of travel position of the work tool and storage of the generated signals as the target signals.

7. The control system of claim 1, wherein the work tool is a bucket, the desired end of travel position is a first dump position of the bucket, and the controller is further configured to:

establish a second dump position of the bucket generally laterally spaced from the first dump position by storing second target signals indicative of second end of travel positions of the boom member, the stick member and the frame with the work tool positioned at the second dump position;

receive second signals indicative of actuation of the operator input device on the machine, the second operator input device actuation signals indicating a desired movement of the work tool towards the second dump position;

determine positions and velocities of the boom member, the stick member and the frame based at least in part upon signals received from the sensors on the machine;

generate second command signals to control movement of the boom member, the stick member and the frame based upon the second operator input device actuation signals, proximity of the boom member, the stick member and the frame to their respective second end of travel positions and the velocities of the boom member, the stick member and the frame;

transmit the second command signals to the control system to control movement of the boom member, the stick member and the frame near the second dump position; and operate in a predetermined sequence controlling movement near the first dump position and the second dump position such that the bucket alternates dump positions between the first dump position and the second dump position upon dumping the bucket at the first dump position and the second dump position.

8. The control system of claim 1, wherein the controller is further configured to store pitch and roll target signals indicative of pitch and roll target positions of the machine relative to an global reference and generate the command signals in part based upon proximity of the machine to the pitch and roll target positions.

9. A machine, comprising:

a frame, and a frame sensor operatively connected to the frame;

a boom member operatively connected to the frame, and a boom sensor operatively connected to the boom member;

a stick member operatively connected to the boom member, and a stick sensor operatively connected to the stick member;

a work tool movable to a desired end of travel position and operatively connected to the stick member, and a work tool sensor operatively connected to the work tool;

a control system configured to move the boom member, the stick member and frame;

an operator input device; and a controller configured to:

store target signals indicative of end of travel positions of the boom member, the stick member and the frame;

receive signals indicative of actuation of an operator input device associated with the machine, the operator input device actuation signals indicating a desired movement of the work tool;

determine positions and velocities of the boom member, the stick member and the frame based at least in part upon signals received from sensors on the machine;

compare desired speeds of movement of the boom member, the stick member and the frame based upon the operator input device actuation signals to a data map including speeds of movement of the boom member, the stick member and the frame based upon proximity to their respective end of travel positions and the velocities of the boom member, the stick member and the frame;

generate command signals to control movement of the boom member, the stick member and the frame based upon whichever movements are slower as between the desired speeds of movement and the data map speeds of movement upon the work tool moving towards the end of travel position;

generate command signals to control movement of the boom member, the stick member and the frame at the desired speeds of movement upon the work tool moving away from the end of travel position; and transmit the command signals to the control system to control movement of the boom member, the stick member and the frame near the desired end of travel position of the work tool.

10. The machine of claim 9, wherein the controller is further configured to store signals indicative of positions of the boom member, the stick member and the frame as the target signals based upon positioning of the work tool at the desired end of travel position and actuation of a target operator input device associated with the machine.

11. The machine of claim 9, wherein the controller is further configured to generate signals indicative of desired positions of the boom member, the stick member and the frame at least in part based upon predetermined dimensions and a global positioning signal of the machine together with predetermined dimensions and a global positioning signal of a target machine positioned near the desired end of travel position of the work tool and store the generated signals as the target signals.

12. The machine of claim 9, wherein the machine further includes pitch and roll sensors and the controller is further configured to store pitch and roll target signals from the pitch and roll sensors indicative of pitch and roll target positions of the machine relative to an global reference and generate the command signals at least in part based upon proximity of the machine to the pitch and roll target positions.

13. A controller-implemented method of controlling movement of a work tool of a machine near a desired end of travel position of the work tool, the method comprising:

identifying a desired end of travel position of the work tool;

storing target signals within a controller indicative of end of travel positions of a work tool, a boom member, a stick member and a frame on the machine;

receiving signals at the controller indicative of actuation of an operator input device associated with the machine, the operator input device actuation signals indicating a desired movement of the work tool;

determining positions and velocities of the boom member, the stick member and the frame based at least in part upon signals received by the controller from sensors on the machine;

comparing desired speeds of movement of the boom member, the stick member and the frame based upon the operator input device actuation signals to a data map including speeds of movement of the boom member, the stick member and the frame based upon proximity to their respective end of travel positions and the velocities of the boom member, the stick member and the frame;

generating command signals within the controller to control movement of the boom member, the stick member and the frame based upon whichever movements are slower as between the desired speeds of movement and the data map speeds of movement upon the work tool moving towards the end of travel position;

generating command signals to control movement of the boom member, the stick member and the frame at the desired speeds of movement upon the work tool moving away from the end of travel position; and transmitting the command signals from the controller to a control system to control movement of the boom member, the stick member and the frame near the desired end of travel position of the work tool.

14. The method of claim 13, further including the steps of positioning of the work tool at the desired end of travel position and actuating a target operator input device associated with the machine to store the target signals within the controller.

15. The method of claim 13, further including the step of storing automatically within the controller the target signals upon entering a learning mode and the work tool performing a predetermined operation.

16. The method of claim 13, further including the step of generating signals within the controller indicative of desired end positions of the boom member, the stick member and the frame at least in part based upon predetermined dimensions and a global positioning signal of the machine together with predetermined dimensions and a global positioning signal of a target machine positioned near the desired end of travel position of the work tool and storing the generated signals as the target signals.

17. The method of claim 13, wherein the storing step is based upon one of multiple modes of operation, a first mode including actuating a target operator input device to store signals indicative of positions of the boom member, the stick member and the frame as the target signals and a second mode including generating signals indicative of desired end positions of the boom member, the stick member and the frame at least in part based upon predetermined dimensions and a global positioning signal of the machine together with predetermined dimensions and a global positioning signal of a target machine positioned near the desired end of travel position of the work tool and storing the generated signals as the target signals.

18. The method of claim 13, wherein the work tool is a bucket, the desired end of travel position is a first dump position of the bucket, and further including the steps of:

identifying a second dump position of the bucket generally laterally spaced from the first dump position by storing second target signals within the controller indicative of second end of travel positions of the boom member, the stick member and the frame with the work tool positioned at the second dump position;

after dumping the bucket at the first dump position:

receiving second signals at the controller indicative of actuation of the operator input device on the machine, the second operator input device actuation signals indicating a desired movement of the work tool towards the second dump position, determining positions and velocities of the boom member, the stick member and the frame based at least in part upon signals received by the controller from the sensors on the machine, generating second command signals within the controller to control movement of the boom member, the stick member and the frame based upon the second operator input device actuation signals, proximity of the boom member, the stick member and the frame to their respective second end of travel positions and the velocities of the boom member, the stick member and the frame, transmitting the second command signals from the controller to the hydraulic system to control movement of the boom member, the stick member and the frame near the second dump position; and after dumping the bucket at the second dump position, repeating the steps of receiving, determining, generating and transmitting with respect to the first dump position.

* * * * *